US011413209B2

(12) United States Patent
De La Torre Barreiro

(10) Patent No.: US 11,413,209 B2
(45) Date of Patent: Aug. 16, 2022

(54) DEVICE FOR MASSAGING AND STRETCHING CERTAIN BODY PARTS

(71) Applicant: DEMAC, S.A., Boadilla del Monte (ES)

(72) Inventor: José Luis De La Torre Barreiro, Boadilla del Monte (ES)

(73) Assignee: DEMAC, S.A., Boadilla del Monte (ES)

( * ) Notice: Subject to any disclaimer, the term of this patent is extended or adjusted under 35 U.S.C. 154(b) by 0 days.

(21) Appl. No.: 17/267,311

(22) PCT Filed: Mar. 27, 2019

(86) PCT No.: PCT/ES2019/070201
§ 371 (c)(1),
(2) Date: Feb. 9, 2021

(87) PCT Pub. No.: WO2020/030834
PCT Pub. Date: Feb. 13, 2020

(65) Prior Publication Data

US 2021/0338514 A1 Nov. 4, 2021

(30) Foreign Application Priority Data

Aug. 9, 2018 (ES) ..... ES201830816

(51) Int. Cl.
*A61H 1/02* (2006.01)
*A61H 23/02* (2006.01)

(52) U.S. Cl.
CPC ..... *A61H 1/0288* (2013.01); *A61H 23/0263* (2013.01); *A61H 2201/0103* (2013.01);
(Continued)

(58) Field of Classification Search
CPC .... A61H 23/00; A61H 23/002; A61H 23/004; A61H 23/006; A61H 1/02; A61H 1/0288;
(Continued)

(56) References Cited

U.S. PATENT DOCUMENTS

2012/0059291 A1* 3/2012 Nguyen ..... A61H 1/0288 601/40
2012/0203141 A1* 8/2012 Shantha ..... A61M 19/00 604/290

(Continued)

FOREIGN PATENT DOCUMENTS

FR 1018104 A 12/1952
GB 2479358 A 10/2011

(Continued)

OTHER PUBLICATIONS

International Search Report dated Jul. 8, 2019.

*Primary Examiner* — Samchuan C Yao
*Assistant Examiner* — Nathan M Le
(74) *Attorney, Agent, or Firm* — William H. Honaker; Dickinson Wright PLLC

(57) ABSTRACT

A device comprising at least two ferrules, which may have a first ferrule (3) and a second ferrule (4), joined by elements by programmable elastic means (5) in the manner of elastic rods or straps with shape memory, wherein each ferrule (3) (4) has a housing (3.1) (4.1) for housing vibration-generating means (6) and (7) fed by means of cables (6.1) and (7.1), respectively, by a control unit which is in charge of controlling and adjusting vibration intensity, phase and speed, wherein the programmable elastic means is preferably a nickel-titanium alloy, and may be compressed air. A device is obtained that is simple to implement and apply in the treatment of arthritis and arthrosis disorders.

7 Claims, 6 Drawing Sheets

(52) U.S. Cl.
CPC .. *A61H 2201/105* (2013.01); *A61H 2201/165* (2013.01); *A61H 2201/1635* (2013.01); *A61H 2201/5007* (2013.01); *A61H 2205/067* (2013.01)

(58) Field of Classification Search
CPC ..... A61H 1/024; A61H 1/0258; A61H 19/00; A61H 19/30; A61H 2201/123
See application file for complete search history.

(56) References Cited

U.S. PATENT DOCUMENTS

2013/0072829 A1* 3/2013 Fausti ..... A63B 23/16 601/40
2013/0073939 A1* 3/2013 Honsowetz ..... G06F 40/18 715/212
2013/0309951 A1 11/2013 Benvegnu et al.
2014/0066925 A1* 3/2014 Howard ..... A61H 23/00 606/38
2015/0032036 A1* 1/2015 Brown ..... A61H 23/02 601/46
2015/0245972 A1 9/2015 Arakawa
2016/0332817 A1* 11/2016 Ahdoot ..... A63B 21/4019
2017/0157430 A1* 6/2017 Cheatham, III ..... A61N 1/0484
2017/0157431 A1* 6/2017 Cheatham, III ..... A61N 1/0476
2017/0168565 A1 6/2017 Cohen
2018/0296419 A1* 10/2018 Tong ..... A61H 1/0288
2019/0282426 A1* 9/2019 Weidner ..... A61H 1/0288

FOREIGN PATENT DOCUMENTS

WO 9632915 A1 10/1996
WO 2010033055 A1 3/2010
WO 2017029406 A1 2/2017

* cited by examiner

DEVICE FOR MASSAGING AND STRETCHING CERTAIN BODY PARTS

CROSS-REFERENCE TO RELATED APPLICATIONS

The present application is a 35 U.S.C. § 371 national stage application of PCT Application No. PCT/ES2019/070201, filed on Mar. 27, 2019, which claims priority to Spanish Patent Application No. P201830816, filed on Aug. 9, 2018, the entire contents of which are incorporated by reference in their entireties.

OBJECT OF THE INVENTION

The object of the present invention, as established in the title of the invention, is a device for massaging and stretching certain body parts, preferably for treating arthritis and arthrosis and preferably in fingers, i.e. a device which, placed on the body part to be treated and particularly on fingers and joints, enables the treatment and improvement of disorders in fingers, i.e. it works as an individual device (active stack splint) which performs the functions of stretching, straightening, heating and massaging and/or vibrating the hinge joints between the phalanges of the fingers.

Also object of the present invention is a glove or similar wherein the individual device is installed in at least one of the fingers of the glove developed for one of the fingers and can also be used for the gloves.

The present invention is characterised in the special configuration and design of the elements used, their nature and functionality such that a device for treating and improving disorders derived from arthrosis is achieved, since it is made of at least two perimeter ferrules or ring elements arranged in alignment joined by their opposite sides by a means capable of controllably modifying the distance that separates the ferrules that generates an axial force between ferrules, wherein at least one of the ferrules has means for housing vibration-generating means fed by one control unit (8), such that the dual massage and/or vibration functionality, on the one hand and, on the other, the stretching of the body part where it is applied, preferably on the fingers, is performed simultaneously to avoid compression during the vibration and to correct the deformation that exists in the disorder.

BACKGROUND OF THE INVENTION

Fingers, hands or wrists suffer the consequences of an excessive use of the joints or joint, muscular or bone problems or even as a consequence of medical conditions. Effects such as burning, itching or pain are generated and these parts can even feel tired, painful, rigid, numb, hot, cold or tingling.

It occurs at times when it is not possible to move them as well as usual or they may be swollen. The hands may have even turned a different colour, such as red, pale or blue. A lump may have appeared on the wrist, palm or fingers.

Problems in fingers, hands or wrists may be caused by an injury. However, there are many other causes of problems in fingers, hands or wrists.

Problems due to excessive use:

Carpal tunnel syndrome is caused by pressure on a nerve (median nerve) in the wrist. Symptoms include tingling, numbing, weakness or pain in fingers and hands.

Pain in tendons is actually a symptom of tendinosis, a series of tiny tears (micro-tears) in the tendon tissue or around it. In addition to pain and sensitivity, common symptoms of tendon injuries include less strength and mobility in the affected area.

De Quervain syndrome can occur in the hand and wrist when the tendons and sheath (protective sheath) of the tendons that run on the thumb side of the wrist become swollen and inflamed.

Repetitive motion disorder is a term used to describe symptoms such as pain, swelling or sensitivity that occur upon repeating the same movement over and over.

Writer's cramp is caused by the repetitive hand or finger movements, such as the activities of writing or typing.

Trigger finger or trigger thumb occurs when the flexor tendon and its covering become thickened or swollen in a finger or thumb.

Bone, muscular or joint problems:

Dupuytren's contracture is an abnormal thickening of the tissue underneath the skin, on the palm of the hand or on the hands and, at times, on the soles of the feet. Lastly, thickened skin and tendons (palmar fascia) can limit movement or cause the fingers to bend and cannot be stretched.

Problems due to medical conditions:

Diabetes, pregnancy, osteoarthritis, gout, rheumatoid arthritis, lupus, Raynaud's phenomenon, infections.

The excessive use of the finger when writing can cause joint stress and Quervain's tenosynovitis (inflammation of the covering of the sheath of the long abductor tendon and of the short extensor of the thumb, which occurs when passing through the tunnel near the radial styloid process) and thumb rhizarthrosis.

Doctors at the Mayo Clinic in Minnesota (USA) pointed out that every year they see an increasing number of patients suffering from a disorder called "texting thumb". It is the inflammation of the terminal portion of the muscle which, if it continues to deteriorate, determines a more severe injury. It is caused when the tendon bends and flexes, causing inflammation of the finger. This disorder was formerly suffered by many factory employees due to the nature of their work.

Kristin Zhao, a biomedical engineering specialist at the institution, has been studying this disorder for seven years. She considers that thumbs make uncomfortable movements when handling a cell phone. She explains that the joints become loosened and weakened, such that the bones move differently than normal. This can cause pain and eventually osteoarthritis.

Different devices that seek to alleviate muscular and finger joint pain have been developed in the state of the art using vibrating means aimed at massaging the painful area, such as those described in the patents: US2013309951, GB2479358, WO2010033055 and WO9632915, which disclose devices based on vibrating means applied to the fingers using a ferrule on which to mount the vibrating means.

However, none of said devices performs any stretching function of the fingers simultaneously while massaging and/or vibration is produced on the joint area.

Therefore, the object of the present invention is to develop a device that can be simply and effectively applied, for all the aforementioned conditions, wherein a massage/vibration is simultaneously applied to the joint area while producing a stretching effect of the finger or affected area, all without need to visit a specialised centre where said treatment is applied, developing for such purpose a device such as that described below and which is set out in its essentiality in claim one.

DISCLOSURE OF THE INVENTION

The object of the present invention is a device for massaging and stretching certain body parts, preferably for treating arthritis and arthrosis of body parts, preferably in the fingers and toes.

The device comprises at least two ferrules joined by their opposing sides by a means capable of controllably modifying the distance that separates both ferrules, which can be a programmable elastic means that generates a fixed or variable axial force between ferrules, wherein at least one of the ferrules has at least one vibration-generating means.

The means capable of modifying the distance that separates both ferrules generates a stable axial force between ferrules and may be a controlled spring or a metal with shape memory, programmable plastic, the electromagnetic actuator itself or straps or wires or sheets or wires with shape memory or any other means that makes it possible to vary its length at the electronic controllers will, whether mechanically, by temperature, current, etc.

The objective of the means capable of modifying the distance that separates the ferrules is to generate a force that initially separates the two phalanges, creating sufficient offset so that the vibrating massage does not exert pressure thereon when it has approximation value.

Another way of generating stable axial force between the ferrules is by means of air pressure; said air pressure can also be used to fix the ferrules to the fingers in order to ensure better stretching.

The ferrules may have the most convenient geometric configuration to house the fingers in their interior, wherein one or all of the ferrules may adopt the form of hollow cylinders or wherein one of the ferrules may adopt the form of a finger cot or combinations of the foregoing forms.

The ferrules must be fixed to the finger in different ways, which may be by means of an adhesive, by exerting pressure or using a lung or bladder.

At least one of the ferrules includes a vibration mechanism having means that make it possible to control the intensity, phase and speed thereof. These vibration mechanisms can be implemented as eccentric mass motors or by means of electromagnetic actuators with different static or moving coil configuration. Eccentric mass motors can also be combined with electromagnetic actuators in the same assembly.

Said straps, wires or cables or sheets are small-section elements that contract (typically to 2%-5% of their length) like muscles when handled electrically or heated. This flexing or shortening capacity is a characteristic of certain alloys, which directly changes its internal structure at certain temperatures. In the case of Flexinol®, it is made to contract when circulating a current therethrough, although there are many materials having different properties that can be used.

The ferrules also have housings in which vibration-generating means are disposed. Those which can be used include motors in combination with an eccentric, or an electromagnetic actuator with an oscillating mass in its interior, or movement combined with the vibration thanks to an electromagnetic mechanism (figures) that combines the two desired functions.

The device may have means for controlling the vibration in parameters such as intensity, phase and speed thereof.

The vibrating movement of the means are controlled such as to establish mutual approximation, distancing or axial movement in the same direction. This is made possible by the phase control of the vibration means using the supervision system. A low-frequency harmonic movement can also be generated in the event of having similar phases.

In this way, if the two vibration means have equal phases, then an identical axial movement effect takes place. However, if the phases are in opposition there is an alternating local extension and compression effect that is subsequently modified by the elastic means to suppress the compression, leaving only alternate extension between phalanges and benefiting the patient. Lastly, if the phases are slightly shifted there will be a massage at low-speed (in accordance with the amount of phase difference).

The combined actuation of the means capable of controllably modifying the distance that separates the ferrules together with the ferrules having vibration-generating means have a combined effect on the joint: on the one hand, massaging it while having the effect of modifying the distance or free space in the joint, separating the phalanges due to an axial force, which alleviates and reduces the pain caused by the action o arthrosis and/or arthritis.

The device can be used with a finger cot previously placed on the finger to be treated and wherein said finger cot has an analgesic and/or anti-inflammatory in its interior that enhances the treatment. Lastly, the device may be covered by a second protective finger cot.

The applications of this device include, inter alia, the following:

Treatment of arthrosis and arthritis,

Treatment of tendinitis,

Carpal tunnel syndrome,

Treatment of Dupuytren's contracture, which is a fibrosis of the palmar fascia. Its origin is unknown and causes the hand to progressively close due to the retraction of the superficial palmar aponeurosis and trigger finger.

Another application of this technology can be applied to the Achilles tendon, placing the vibration/extension means on both ends of the tendon as explained earlier, with the relevant modifications for fixing to the body.

As also mentioned earlier, an object of the present invention is to develop a glove or similar equipped with the described device, which will be placed at least on one of the fingers of the glove and even on all of them, due to which different fingers may be treated simultaneously.

Unless otherwise indicated, all the technical and scientific elements used in this specification have the meaning usually understood by a person skilled in the art to which this invention belongs. In the practice of this invention, methods and materials similar or equivalent to those described in the specification can be used.

Throughout the description and claims, the word "comprises" and its variants do not intend to exclude other technical characteristics, additives, components or steps. For persons skilled in the art, other objects, advantages and characteristics of the invention shall be partly inferred from the description and partly from the practice of the invention.

DESCRIPTION OF THE FIGURES

To supplement the description made and with the aim of helping to better understand the characteristics of the invention, in accordance with a preferred example of a practical embodiment thereof, a set of drawings is provided as an integral part of said description wherein, for illustrative and non-limiting purposes, the following has been represented.

PREFERRED EMBODIMENT OF THE INVENTION

In view of the figures, a preferred embodiment of the proposed invention is described below.

Figure 1:
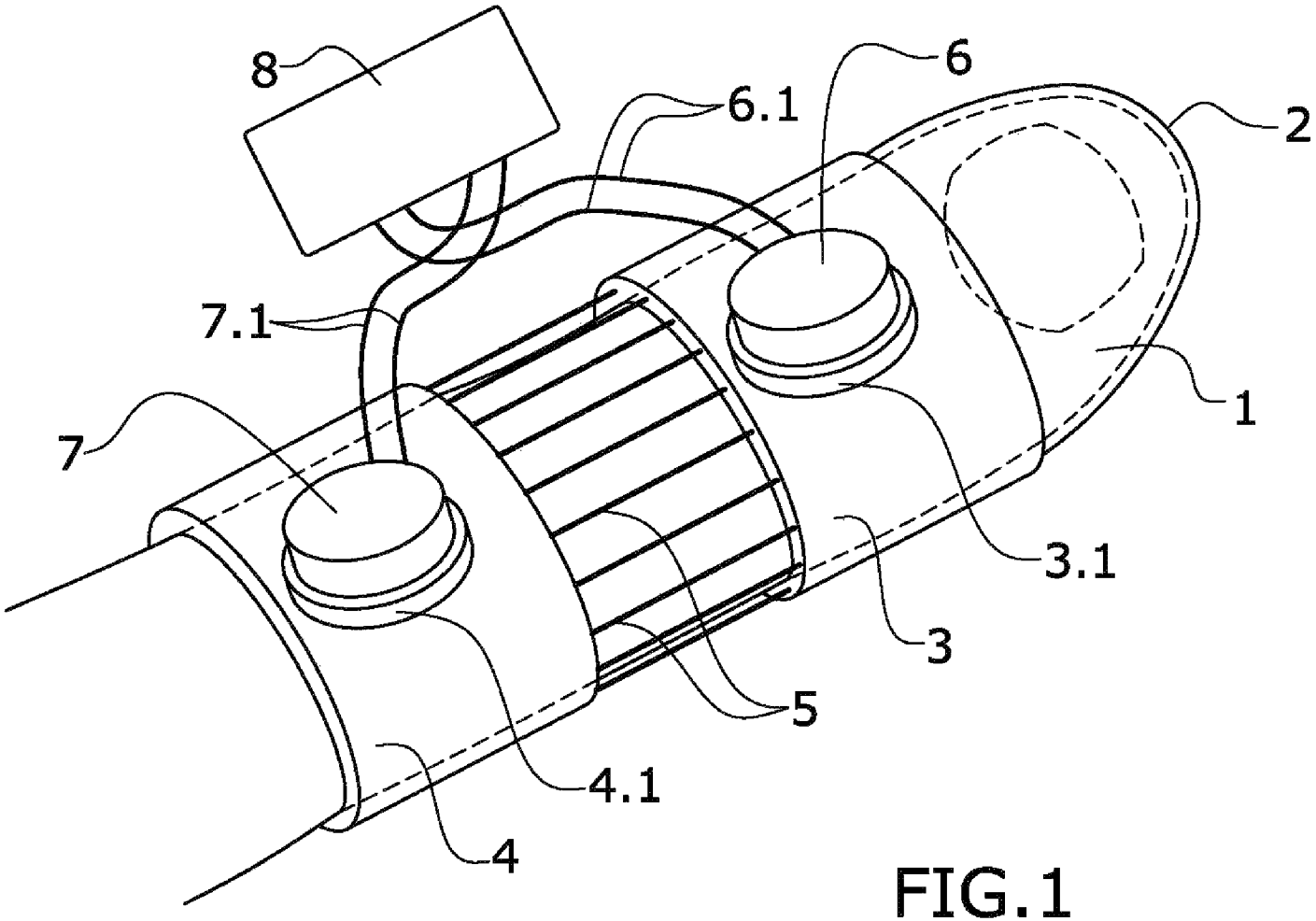
FIG. 1 shows a general view of the device applied to a finger.
Figure 2:
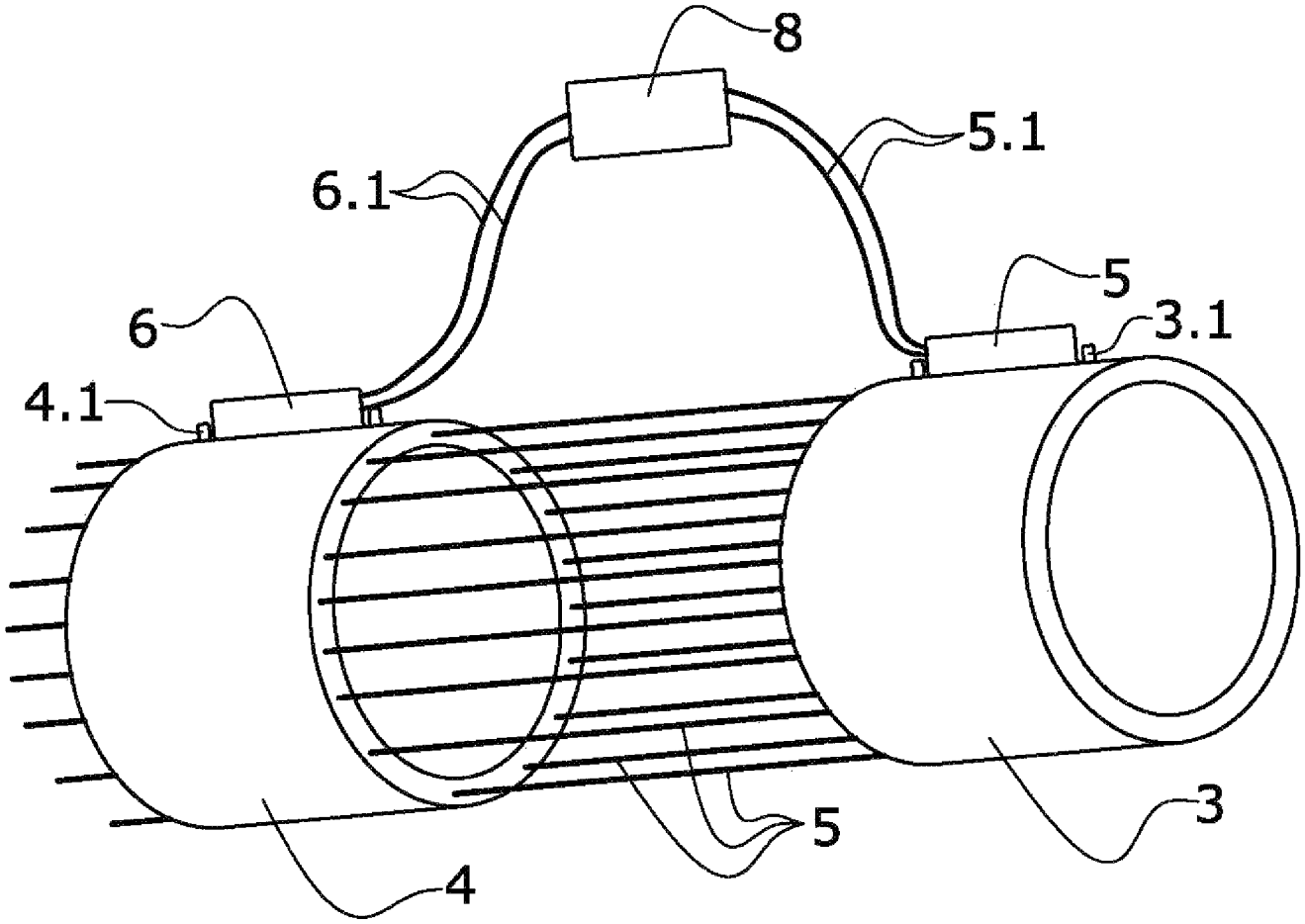
FIG. 2 shows a detailed view of the device as a whole.
Figure 3:
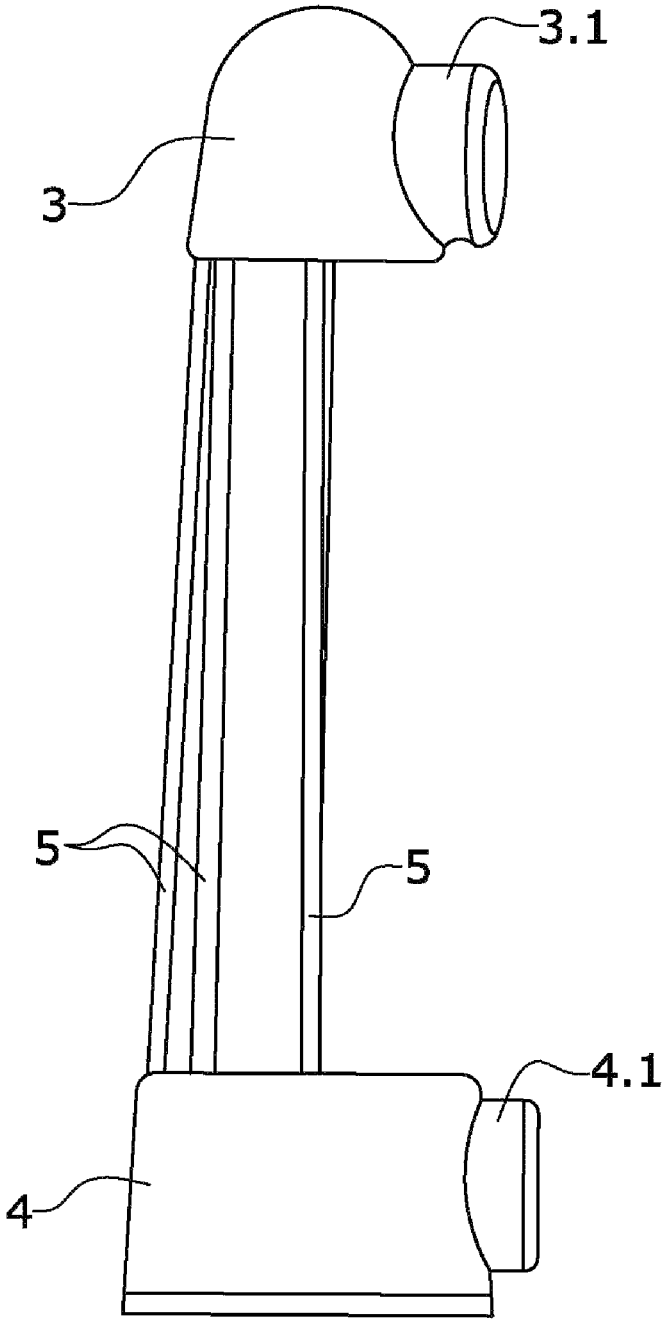
FIG. 3 shows a possible form of embodiment wherein one of the ferrules is a finger cot.

FIG. 1 shows a finger (1) whose tip is covered by a finger cot (2) containing an anti-inflammatory and/or analgesic gel or pomade disposing, on the part of said finger cot that may be covered, the device strictly speaking, which comprises a first ferrule (3) and a second ferrule (4), both, in the embodiment shown, having a cylindrical hollow configuration and joined by elements by means (5) capable of controllably modifying the distance that separates the ferrules in the manner of elastic rods or straps with shape memory.

The means (5) capable of controllably modifying the distance that separates the ferrules and generator of a stable axial force may vary, such as thermostretch wires, used like muscles in robotics, or compressed air or any other axial force-generating means or elastic material susceptible of recovering its initial position.

A material is said to have shape memory when it recovers its shape after it stops applying the external force that deformed it.

A possible elastic material used to manufacture thermostretch wires may be a wire of a special nickel-titanium alloy which, when the current passes through it or heated, increases in length and is capable of moving or lifting objects. Said wires can be Nitinol® or Flexinol® or any material with elastic memory that allows it to recover its initial shape.

Nitinol is a material with shape memory that can recover its shape after deforming it in an apparently irreversible way. It is a Ni—Ti alloy known as Nitinol.

There are housings (3.1) and (4.1) on the first ferrule (3) and the second ferrule (4), respectively, in which to house vibration-generating means (6) and (7), respectively, that may be both a motor associated with an eccentric and an electromagnetic mechanism having an oscillating coil housed in its interior or the combination of both. The vibration-generating means do not have to be disposed on all the ferrules, but rather may be disposed on only one of the ferrules.

The first vibration-generating means (6) has feed cables (6.1), while the second vibration-generating means (7) has feed cables (7.1), both of which extending from a control unit (8) in charge of adjusting the intensity, phase and speed thereof.

Figure 4:
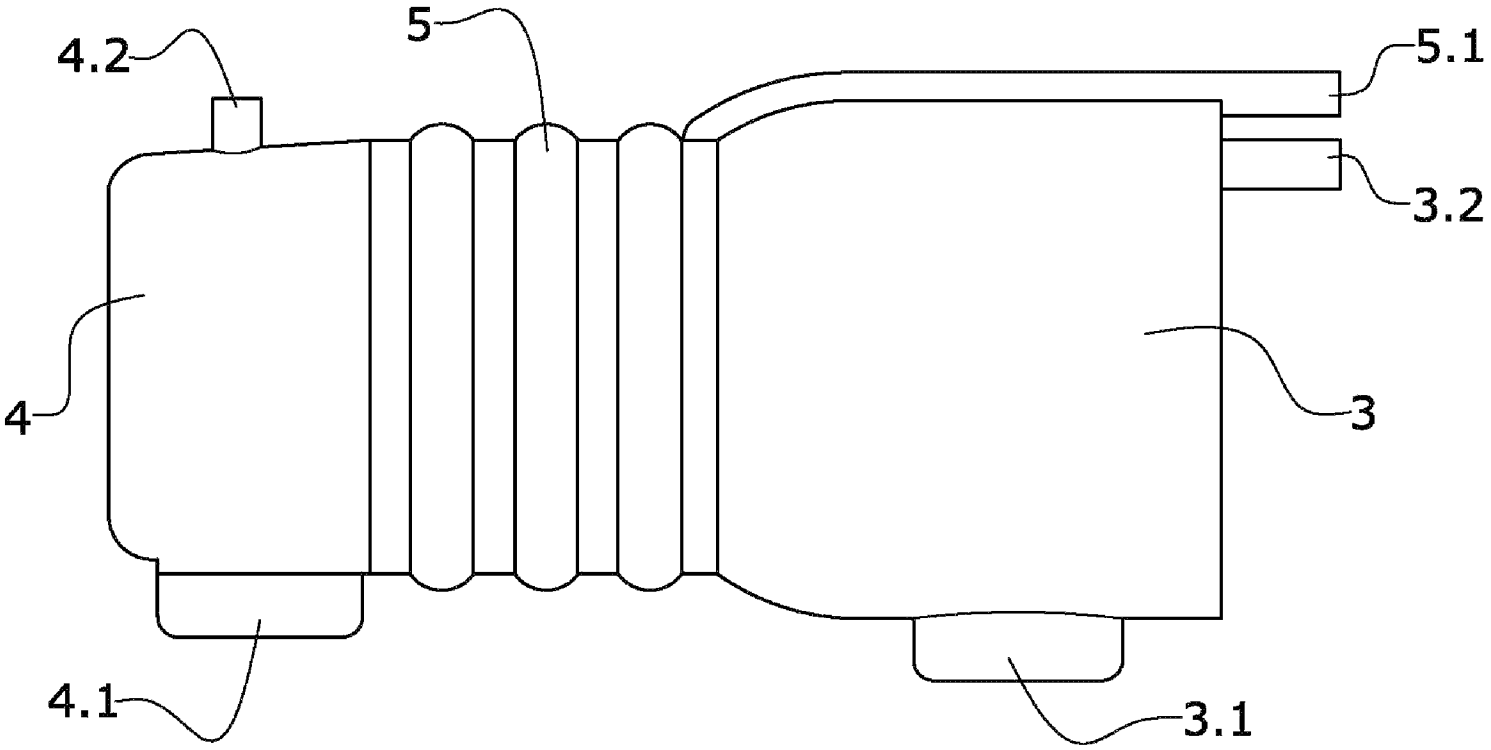
FIGS. 4, 5 and 6 show different views of the device wherein the means for generating a stable axial force is by means of compressed air, also using the air as a means of fixing to the body part whereto it will be applied.
Figure 5:
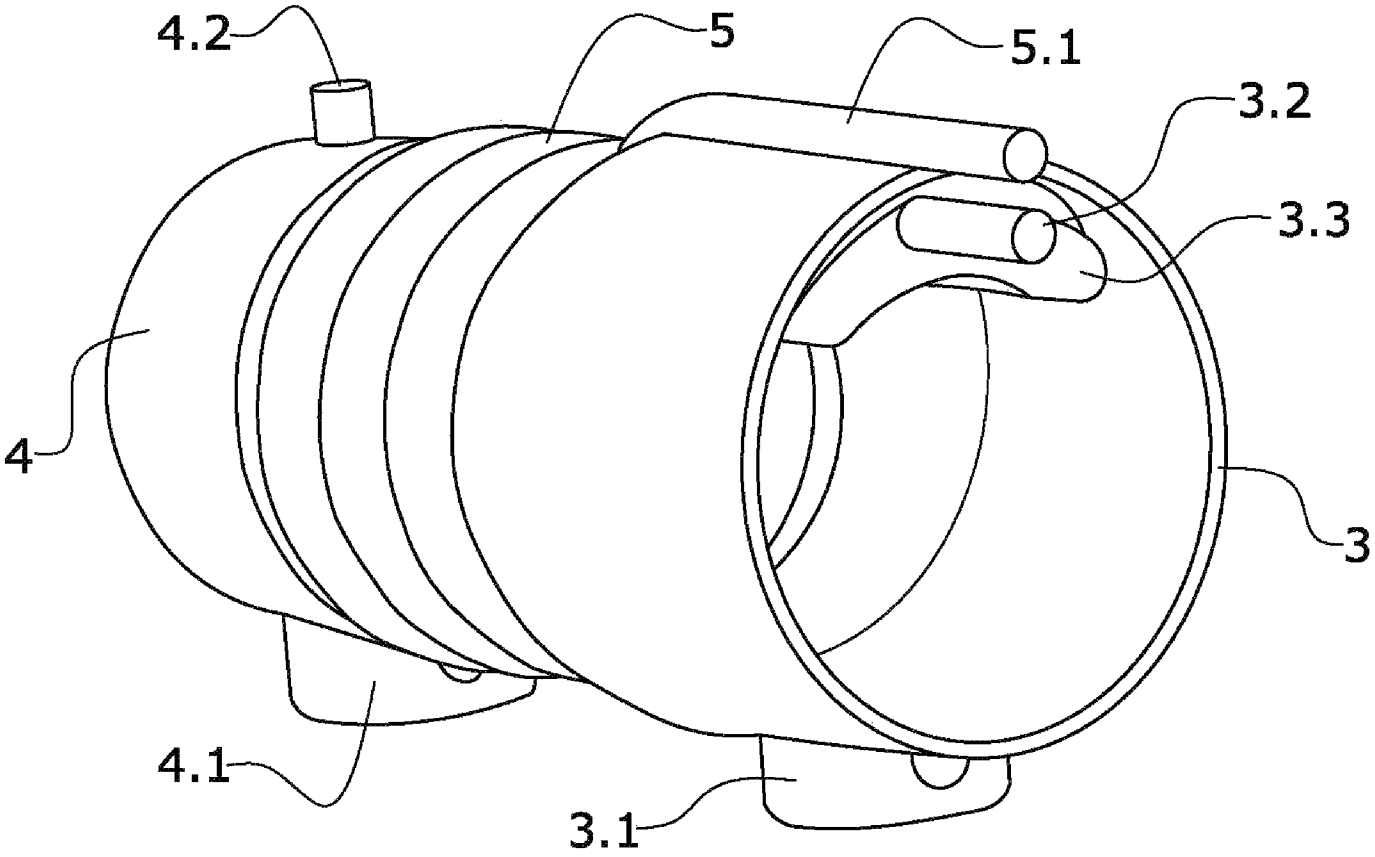
Figure 6:
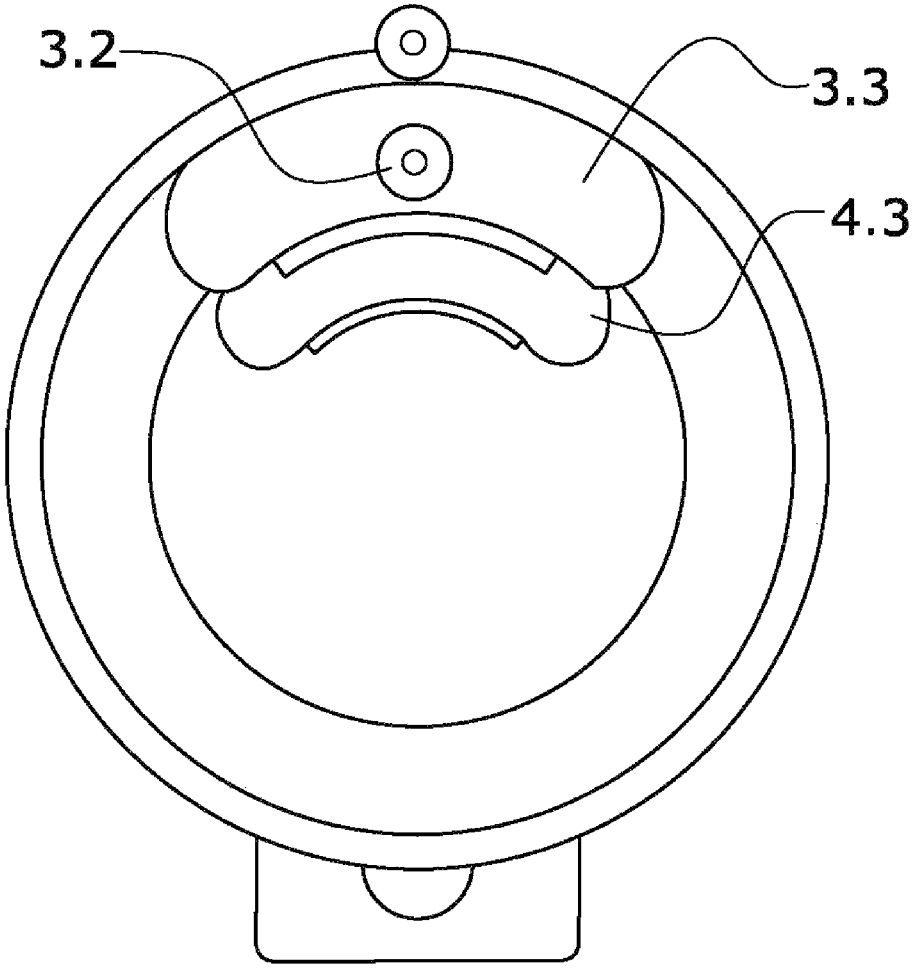

FIGS. 4 to 6 show an embodiment wherein the programmable elastic means (5) that generate a stable axial force consist of cavities filled with compressed air that produce a force or separation between the ferrules (3) and (4).

The compressed air can also be used as a means of fixing the ferrules to the fingers.

It is possible to combine the different means capable of modifying the distance that separates the ferrules (compressed air, thermostretch wires, etc.) with the different means for fixing the ferrules to the fingers (adhesive or by exerting pressure or using a lung or bladder, etc.).

In the embodiment shown in FIG. 4, which is non-limiting, it can be observed that the first ferrule (3) has a duct (3.2) connected to an inflatable lung (3.3) (FIGS. 5 and 6) to which pressurised air is supplied to ensure the fixation of the ferrule to the finger. The second ferrule (4) also has a duct (4.2) that supplies air to its corresponding lung (4.3) (FIG. 6) and that, once inflated, ensures the fixation of the ferrule to the finger.

The means (5) capable of controllably modifying the distance that separates the ferrules have a duct that supplies air (5.1) to conduits inserted between the ferrules (3) and (4) such that the separation between the ferrules varies in accordance with the air pressure supplied, i.e. they generate a stable axial force.

Having sufficiently described the nature of the present invention, in addition to the manner in which to put it into practice, it is hereby stated that, in its essence, it may be put into practice in other embodiments that differ in detail from that indicated by way of example, and to which the protection equally applies, provided that its main principle is not altered, changed or modified.

The invention claimed is:

1. A device for massaging and stretching certain body parts, the device comprising:

at least two ferrules joined by a thermostretch wire containing an Ni—Ti alloy, a current source configured to apply current to the thermostretch wires to modify a distance separating the at least two ferrules and thereby generating an axial force between the at least two ferrules;

wherein the at least two ferrules includes a first ferrule and a second ferrule, the first ferrule having a housing for housing a first actuator fed by a control unit via a first feed cable, and the second ferrule having a housing for housing a second actuator fed by the control unit via a second feed cable;

wherein the control unit supplies and provides phase control and varies magnitudes of vibrations generated by said first actuator and said second actuator;

and wherein the at least two ferrules are fixed to the body part via an adhesive or exerting pressure or using a lung or bladder or a combination thereof.

2. The device for massaging and stretching certain body parts according to claim 1, wherein the first and second ferrules have a hollow cylindrical or finger cot configuration.

3. The device for massaging and stretching certain body parts according to claim 1, wherein, when the lung or the bladder is used for fixing the first and second ferrules, each ferrule has its own lung, whereto air is supplied through a duct.

4. The device for massaging and stretching certain body parts according to claim 1 wherein the control unit is in charge of controlling and regulating the intensity, phase and speed of the vibration generated in the first and second actuators.

5. The device for massaging and stretching certain body parts according to claim 1 wherein each of the first and second actuators is a motor associated with an eccentric actuator or an electromagnetic actuator, or a combination of both actuators, each actuator having an oscillating mass housed in its interior.

6. The device for massaging and stretching certain body parts according to claim 1 wherein the device is used in combination with a finger cot impregnated with an analgesic and/or anti-inflammatory product in its interior.

7. A glove for massaging and stretching certain body parts having the device according to claim 1 wherein at least one of the fingers of the glove has the device for treating arthrosis and arthritis.

* * * * *